US007662045B2

(12) United States Patent
Sammann et al.

(10) Patent No.: US 7,662,045 B2
(45) Date of Patent: Feb. 16, 2010

(54) PLAY SET SLIDE

(75) Inventors: Charles Clifton Sammann, Amarillo, TX (US); Ronald L. Scripsick, Pittsburg, KS (US)

(73) Assignee: Backyard Leisure Holdings, Inc., Pittsburg, KS (US)

( * ) Notice: Subject to any disclaimer, the term of this patent is extended or adjusted under 35 U.S.C. 154(b) by 168 days.

(21) Appl. No.: 11/776,442

(22) Filed: Jul. 11, 2007

(65) Prior Publication Data

US 2009/0017926 A1 Jan. 15, 2009

(51) Int. Cl.
*A63G 21/04* (2006.01)
*A63G 21/00* (2006.01)

(52) U.S. Cl. ..... 472/116; 472/88

(58) Field of Classification Search ..... 472/116, 472/117, 88, 90; 482/35, 36
See application file for complete search history.

(56) References Cited

U.S. PATENT DOCUMENTS

| | | | | |
|---|---|---|---|---|
| 1,526,680 | A * | 2/1925 | Rees | 472/116 |
| 1,626,142 | A * | 4/1927 | McCree | 472/116 |
| 1,888,350 | A * | 11/1932 | Lamar | 472/116 |
| 2,482,637 | A * | 9/1949 | Papa et al. | 472/116 |
| 3,263,994 | A * | 8/1966 | Londgren | 472/116 |
| D330,743 | S | 11/1992 | Mercer | |
| D336,674 | S | 6/1993 | Baer | |
| 5,407,393 | A | 4/1995 | Schmidt | |
| 5,427,574 | A | 6/1995 | Donnelly-Weide | |
| D384,722 | S | 10/1997 | ISiragusa, Jr. et al. | |
| D410,059 | S | 5/1999 | Zeilinger | |
| D410,060 | S | 5/1999 | Zeilinger | |
| 6,342,015 | B1 | 1/2002 | Robertson et al. | |
| D460,511 | S | 7/2002 | Van Deusen | |
| 6,676,529 | B2 | 1/2004 | Pernal | |
| D513,779 | S | 1/2006 | Zeilinger et al. | |
| D520,590 | S | 5/2006 | Zeilinger et al. | |
| D522,604 | S | 6/2006 | Rieber | |
| D536,052 | S | 1/2007 | Han | |
| D536,406 | S | 2/2007 | Nye et al. | |

(Continued)

FOREIGN PATENT DOCUMENTS

JP 7155473 A 6/1995

OTHER PUBLICATIONS

International Search Report and Written Opinion from corresponding PCT Application No. PCT/US2008/069839 (dated Oct. 8, 2008).

*Primary Examiner*—Kien T Nguyen
(74) *Attorney, Agent, or Firm*—Hovey Williams LLP

(57) ABSTRACT

A slide assembly and method of assembling a slide assembly are disclosed for use in conjunction with a recreation structure. The slide assembly includes a pair of side rails with internal grooves along lengths thereof and a slide bed located between the side rails with side margins thereof received within the grooves of the side rails. The slide assembly also includes reinforcements extending between the side rails underneath the slide bed, with ends of each reinforcement received within a recess in each of the side rails. Fasteners, such as screws, selectively secure side margin portions of the slide bed and ends of each reinforcement to each of the side rails. The method of assembling a slide assembly includes inserting each side margin of a slide bed into grooves of the side rails and attaching the slide bed and side rails to a recreation structure.

26 Claims, 6 Drawing Sheets

U.S. PATENT DOCUMENTS

D536,407 S 2/2007 Nye et al.
7,261,614 B2 * 8/2007 Laurienzo et al. ..... 446/444
2003/0004003 A1 1/2003 Lochtefeld
2006/0258470 A1 11/2006 Rieber

* cited by examiner

PLAY SET SLIDE

CROSS-REFERENCE TO RELATED APPLICATION

This application is being filed contemporaneously with application for U.S. Design patent Ser. No. 29/282,101, entitled PLAY SET SLIDE, which is hereby incorporated by reference herein.

BACKGROUND OF THE INVENTION

1. Field of the Invention

The present invention relates generally to slides that are attached to structures for recreational use. More specifically, the present invention concerns a slide assembly that is constructed from multiple component parts and used in a play set, as well as a method of assembling a slide assembly.

2. Discussion of the Prior Art

Those of ordinary skill in the art will appreciate that conventional slides for recreation structures have been molded, most typically out of plastic, in a single piece. While this unitary construction has been satisfactory in some respects, it requires a large amount of space for shipping or transporting the entire slide. Additionally, a single piece slide is necessarily the same material and color, limiting design options for a play set. Finally, it is the nature of a unitary slide that should any portion of the slide break or otherwise need replacement, the entire slide must be replaced, often at significant cost compared to the relatively small size of a damaged portion of the slide.

SUMMARY

The present invention provides a slide assembly comprising component parts for use in a play set. The slide assembly can be stored and shipped in a fraction of the space required to contain a conventional unitary construction slide.

According to one aspect of the present invention, a pair of spaced apart elongated side rails is provided, wherein each of the rails includes an internal groove extending along the length thereof. A slide bed is provided, that extends along the length of, and is supported by, the rails. The slide bed presents left and right side margins, each of which is received in a respective groove.

Another aspect of the present invention concerns a method of assembling a slide for a play set by inserting one side margin of a slide bed into the groove of a first side rail, inserting the other side margin of the slide bed into the groove of a second side rail, and attaching the slide bed and accompanying side rails to a recreation structure.

This summary is provided to introduce a selection of concepts in a simplified form that are further described below in the detailed description of the preferred embodiments. This summary is not intended to identify key features or essential features of the claimed subject matter, nor is it intended to be used to limit the scope of the claimed subject matter.

Various other aspects and advantages of the present invention will be apparent from the following detailed description of the preferred embodiments and the accompanying drawing figures.

BRIEF DESCRIPTION OF THE DRAWING FIGURES

A preferred embodiment of the present invention is described in detail below with reference to the attached drawing figures, wherein.

Figure 1:
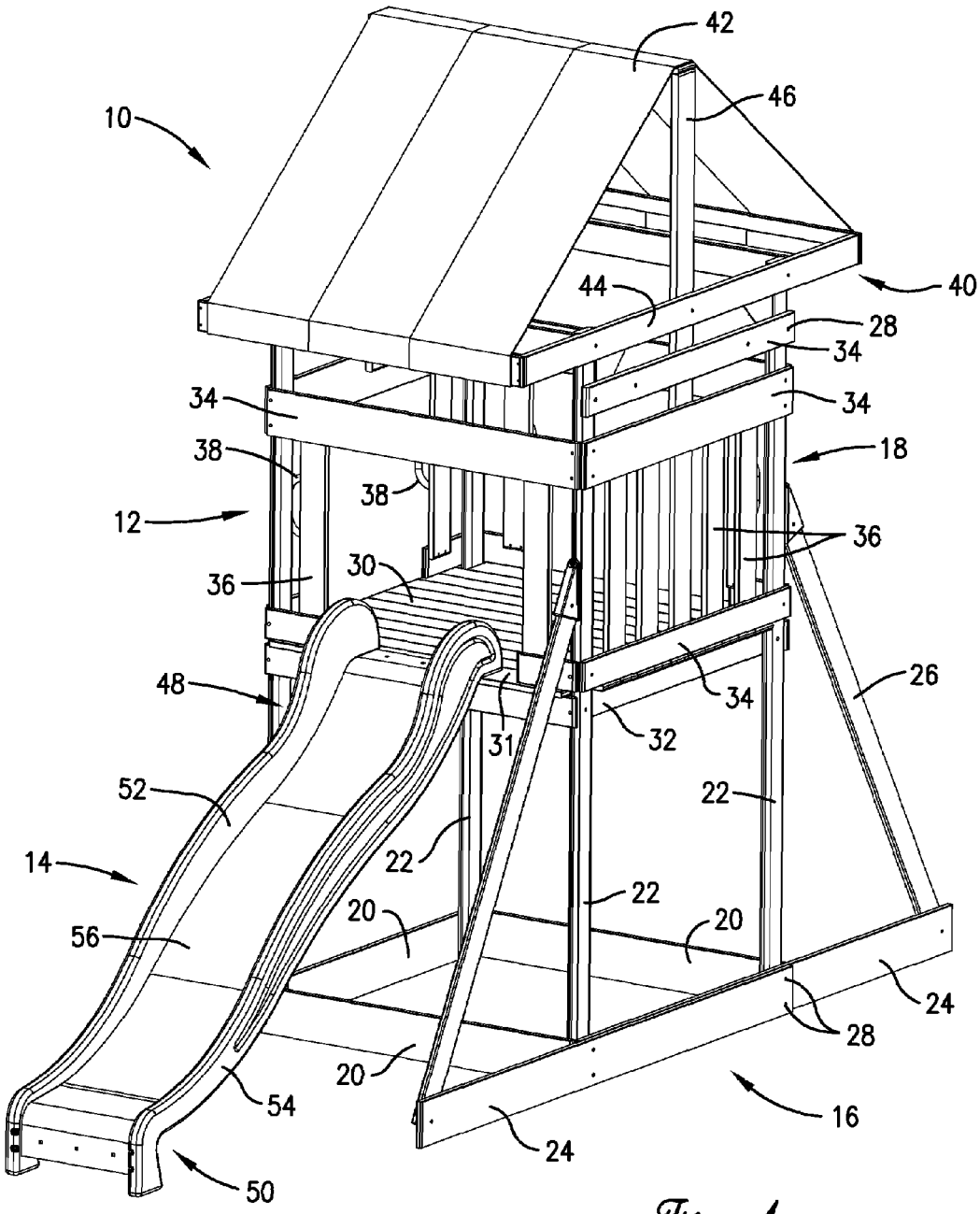
FIG. 1 is a perspective view of a slide assembly constructed in accordance with the principles of a preferred embodiment of the present invention, shown with and secured to a typical recreation structure.
Figure 9:
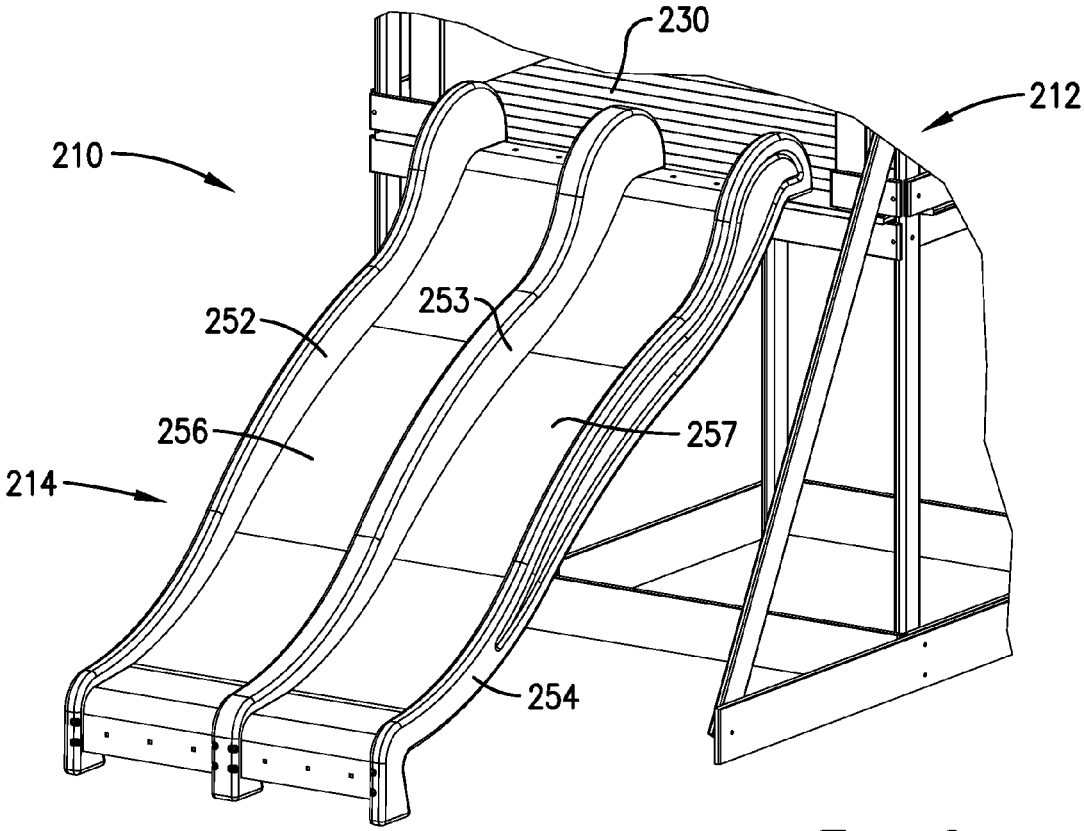
Figure 10:
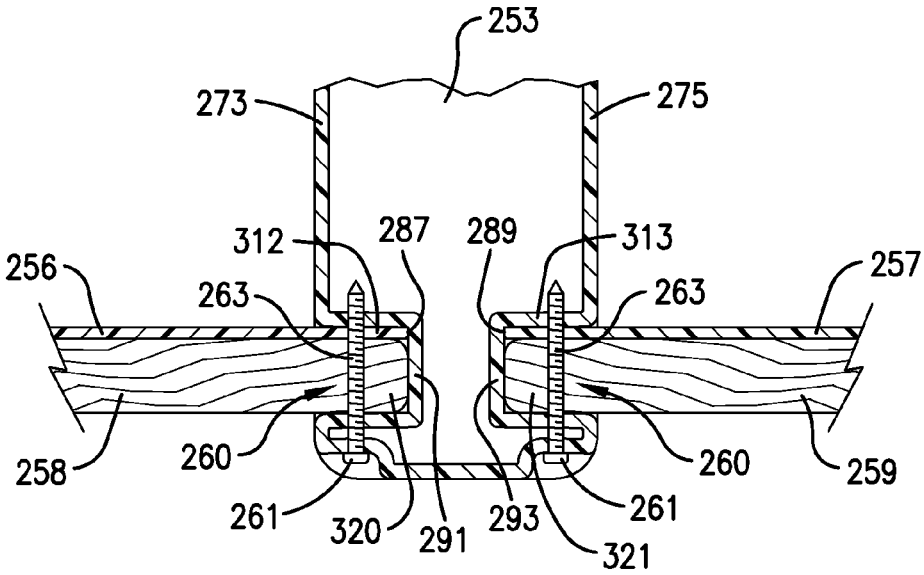

FIG. 9 is a fragmentary perspective view of an alternative slide assembly constructed in accordance with the principles of a second embodiment of the present invention, similar in many respects to the slide assembly shown in FIG. 1, but depicting multiple slide bed portions and an intermediate rail, the alternative slide assembly shown with and secured to a portion of a typical recreation structure; and FIG. 10 is an enlarged, fragmentary side sectional view of a portion of the alternative slide assembly taken along the intermediate rail of FIG. 9, particularly illustrating in detail the manner in which the reinforcements and slide beds are secured to the intermediate rail.

The drawing figures do not limit the present invention to the specific embodiments disclosed and described herein. The drawings are not necessarily to scale, emphasis instead being placed upon clearly illustrating the principles of the preferred embodiments.

DETAILED DESCRIPTION OF THE PREFERRED EMBODIMENTS

The present invention is susceptible of embodiment in many different forms. While the drawings illustrate, and the specification describes, certain preferred embodiments of the invention, it is to be understood that such disclosure is by way of example only. There is no intent to limit the principles of the present invention to the particular disclosed embodiments.

The present invention provides a slide assembly that is constructed from multiple component parts and used in a play set. The invention is also concerned with a method of assembling a slide assembly and attaching it to a recreation structure.

With initial reference to FIG. 1, a play set 10 selected for purposes of illustration combines a recreation structure 12 and a slide assembly 14. The recreation structure 12 broadly includes a support assembly 16 and a play area 18. The support assembly 16 comprises horizontal ground supports 20 that are arranged in a generally square shape and are attached to vertical support members 22. The support assembly 16 also comprises extended ground supports 24 that extend outwardly beyond the ground supports 20 and are attached to angled support members 26. The greater length of the extended ground supports 24 prevents the recreation structure 12 from tipping over. As is customary, hardware 28 is used to secure the assembly parts to one another. The elements of the support assembly 16 are typically made of wood, although it will be readily appreciated by one of ordinary skill in the art that other suitable materials could also be used.

The play area 18 is elevated off of the ground by the support assembly 16. A platform 30, with a frontal slide mounting area 31, comprises the central activity area of the illustrated recreation structure 12 and is supported on horizontal joists 32. The joists 32 are attached to the vertical support members 22 with hardware 28. Horizontal slats 34 form segments of walls that partially enclose the area of the platform 16. The slats 34 are attached to the vertical support members 22 with hardware 28. Vertical slats 36 further partially enclose the area of the platform 16 and are attached to the horizontal slats 34 with hardware 28. Handles 38 are mounted on selected vertical slats 36 to provide stability for children climbing on the play set 10. Similar to the support assembly 16, the elements of the play area 18 are typically made of wood, although it will be readily appreciated by one of ordinary skill in the art that other suitable materials could also be used.

Above the platform 16, a framework 40 supports a canopy 42 that shelters the area of the platform 16 from rain, sun, or other elements. The framework 40 includes a rectangular flat frame 44 and mast elements 46. The canopy attaches to opposite sides of the flat frame 44 and passes over a beam (not shown) that spans the uppermost portions of the mast elements 46. The framework 40 maintains the canopy 42 in an angled roof shape above the platform 16 so that precipitation or other material that falls on the canopy 42 runs off of the canopy 42 and is directed away from the surface of the platform 16. The canopy 42 is typically made of nylon or other suitable material known by those of ordinary skill in the art. The material of canopy 42 is ordinarily brightly colored to provide an aesthetically pleasing look and contrast to the material of the structural elements of the support assembly 16 and play area 18.

It will be recognized that the principles of the present invention are not limited to use with the particular recreation structure 12, illustrated in FIG. 1. As is well known in the art, play sets such as the example shown are very customizable and present numerous possibilities for particular configurations. It will be appreciated by one of ordinary skill in the art that the exemplary play set could take other forms and may include fewer or more elements without departing from the teachings of the present invention. For example, a play set including slide assembly 14 could further include elements such as swings, monkey bars, ladders, climbing walls, poles, bridges, or other elements readily known by one of ordinary skill in the art. It is also within the ambit of the present invention for a play set to simply include a frame and ladder in combination with the slide assembly 14, without additional elements.

Turning now to FIGS. 1-5, the slide assembly 14 presents an upper portion 48 and a lower portion 50 and comprises multiple components. The slide assembly 14 broadly includes a pair of side rails 52, 54, a slide bed 56, reinforcements 58, and screws 60. The slide bed 56 is secured to the side rails 52, 54 to form the modular slide assembly 14. As will be discussed in more detail below, each side rail 52, 54 of the preferred embodiment includes a groove 86, 88 along the length of the rail 52, 54, oriented toward the interior of the slide assembly 14. The slide bed 56 presents side margins 110 and 112 that terminate at side edges 111 and 113 and are received within the grooves 86, 88. The reinforcements 58 extend between the side rails 52, 54 underneath the slide bed 56. Screws 60 secure the slide bed 56 to the side rails 52, 54. Screws 60 also secure the slide bed 56 and reinforcements 58 to the side rails 52, 54.

With reference to FIG. 1, the illustrated embodiment depicts the slide assembly 14 with side rails 52 and 54 oriented on the left and right, receptively, from the vantage point shown in FIG. 1. This orientation of left and right sides, as well as upper and lower vertical designations, remains constant throughout the present detailed description to provide clarity in referring to specific sides of components when such components are shown from different vantage points. Each side rail 52, 54 includes an upper mounting area 62, 64 at the slide assembly upper portion 48. Each side rail 52, 54 also includes a base 66, 68 at the slide assembly lower portion 50 for engaging the ground surface and providing vertical support for the slide assembly 14.

In the illustrated embodiment, the total length of each side rail 52, 54 from the farthest ends of the upper mounting area 62, 64 to the tips of the base 66, 68 is approximately ninety inches (90"). One of ordinary skill in the art, however, will readily appreciate that such length could be adjusted to accommodate differing recreational structure heights or desired slide bed slopes. Additionally, the side rails 52, 54 of the preferred embodiment are hollow, as particularly shown in FIGS. 7 and 8, with a wall thickness of approximately one eighth of an inch (⅛"), although other dimensions (or solid side rails) are also contemplated by the present invention. While the depicted side rails 52, 54 are blow-molded polyethylene, other synthetic resins could be similarly molded or otherwise formed into side rails without departing from the teachings of the present invention.

Figure 2:
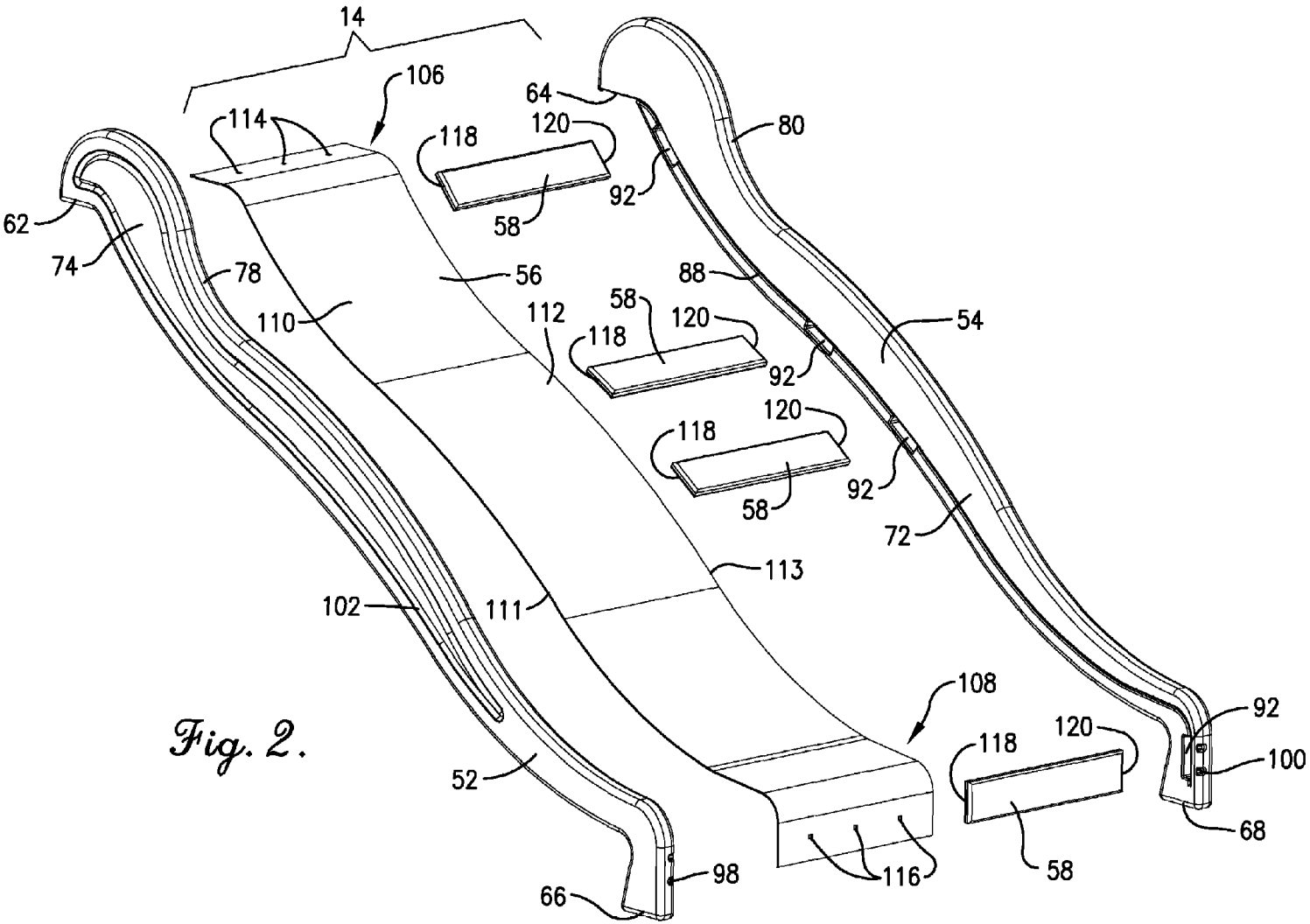
FIG. 2 is an exploded perspective view of the slide assembly shown in FIG. 1, particularly illustrating the separate components thereof, including a pair of side rails, a slide bed, and reinforcements.
Figure 3:
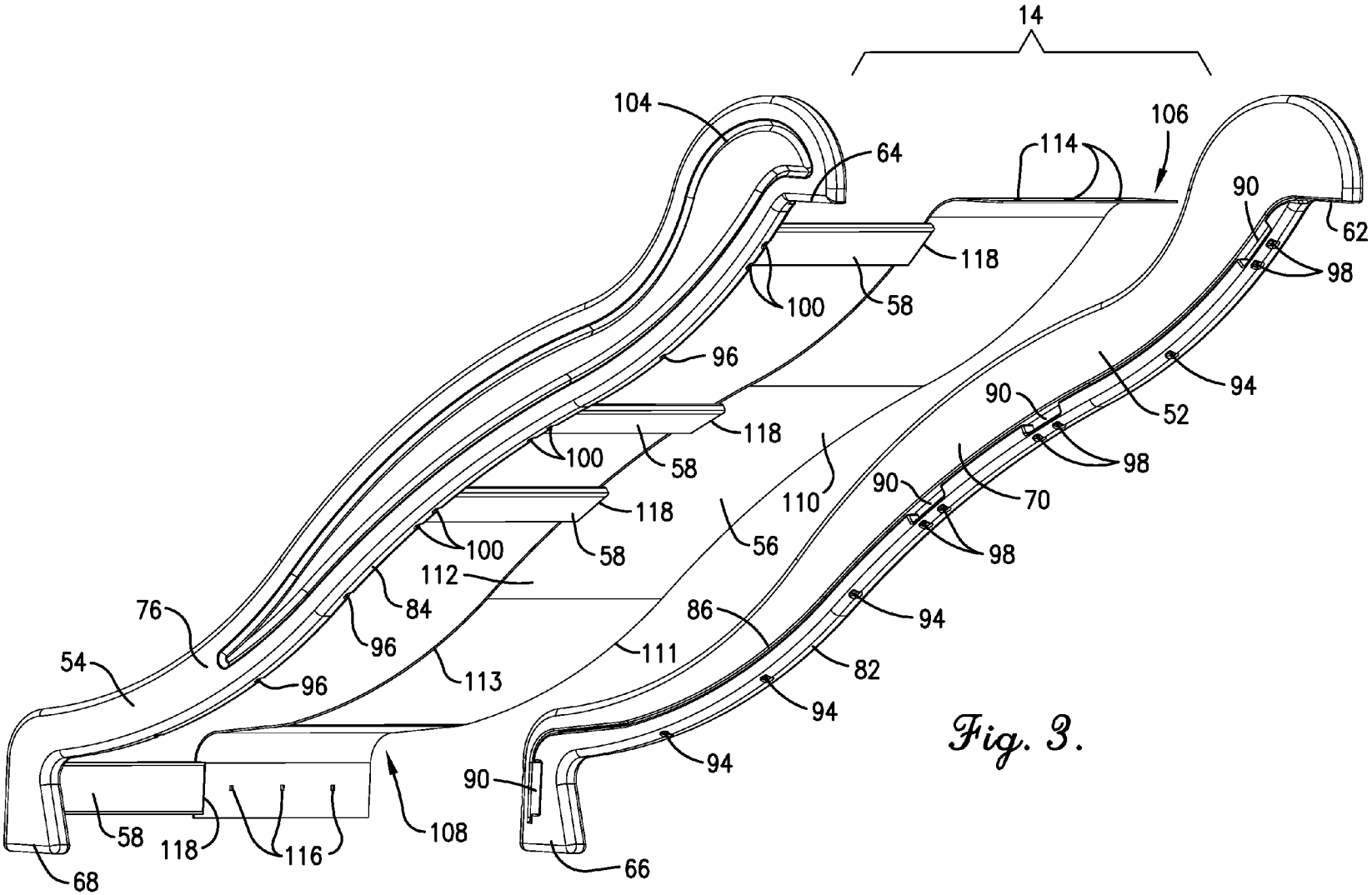
FIG. 3 is an exploded perspective view of the slide assembly, similar to that of FIG. 2, but from the opposite vantage point.

As depicted in detail in FIGS. 2-3, each side rail 52, 54 presents an interior side 70, 72 and an exterior side 74, 76. In the illustrated embodiment, the width of each side rail, defined as the dimension between the interior side 70, 72 and the exterior side 74, 76, is preferably, although not necessarily, approximately one and three quarters inches (1¾"). The interior sides 70, 72 face one another and the exterior sides 74, 76 face away from one another when the slide assembly 14 is in the assembled orientation depicted in FIGS. 1, 4, and 5. Each side rail further presents a top surface 78, 80 and a bottom surface 82, 84. The height of the side rail at any point along the rail is defined as the vertical distance between the top surface and the bottom surface at the particular point of interest. In the illustrated embodiment, the top surfaces 78, 80 and bottom surfaces 82, 84 of both side rails 52, 54 are rounded.

Specifically, with reference to depicted side rail 52, there are no sharp corners at the intersections of the interior or exterior sides 70, 74 and the top or bottom surfaces 78, 82, which can contribute to the safety of individuals using the slide assembly 14. This rounded nature is similarly depicted on the other side rail 54. It is noted, however, that the rounded shape of the top and bottom surfaces 78, 80, 82, 84 of the side rails 52, 54 is not required and that side rails could be formed without such characteristics without departing from the teachings of the present invention.

With further reference to FIGS. 2-3, each interior side 70, 72 of side rails 52, 54 presents a groove 86, 88 extending along the length thereof. As described briefly above and in more detail below, side margins 110 and 112 of the slide bed 56 are preferably received within the grooves 86, 88. Thus, the grooves 86, 88 cooperate to form the path of the slide bed 56. In the illustrated embodiment, this path is curved; however, it is clearly within the ambit of the present invention to provide an alternate embodiment (not shown) of grooves that cooperatively define a straight path. It is further noted that the illustrated grooves 86, 88 are continuous along the length of each groove 86, 88. However, it is also within the ambit of the present invention to provide side rails with discontinuous groove sections, so long as side margins of a corresponding slide bed are received within such groove sections (for example, notched side extensions that correspondingly match the pattern of the groove sections).

Each interior side 70, 72 of side rails 52, 54 also presents a plurality of recesses 90, 92. Each recess 90, 92 is spaced adjacent the groove 86, 88 and between the groove 86, 88 and the bottom surface 82, 84 of each side rail 52, 54. Each recess 90, 92 is configured to receive an end 118, 120 of a reinforcement 58, as described in more detail below. In the illustrated embodiment, each side rail 52, 54 presents four recesses 90, 92; however it will be readily understood by one of ordinary skill in the art that this number is by way of example only and that other numbers of recesses and corresponding reinforcements (including none) could be incorporated without departing from the teachings of the present invention.

Figure 5:
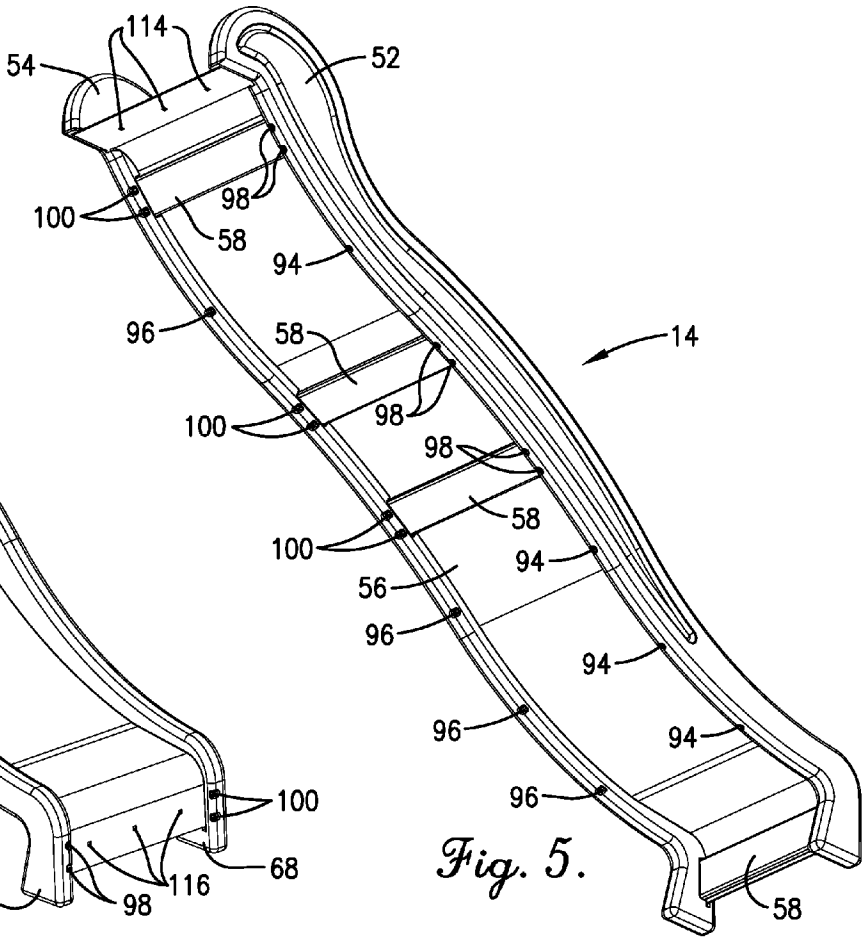
FIG. 5 is a perspective view of the slide assembly, similar to that of FIG. 4, but from the opposite vantage point and without the associated structure of the upper mounting surface.

As depicted in FIGS. 3 and 5, each side rail 52, 54 also includes a plurality of indentations 94, 96 along the bottom surface 82, 84 thereof. Each indentation 94, 96 provides a location at which a screw 60 is inserted to secure the slide bed 56 to the side rail 52, 54, as described briefly above and in more detail below. Additionally, as depicted in FIGS. 2-5, each side rail 52, 54 further includes a plurality of indentations 98, 100 along the bottom surface 82, 84 and along the top surface 78, 80 thereof. Indentations 98, 100 are spaced along the side rails 52, 54 in pairs and each indentation 98, 100 provides a location at which a screw 60 is inserted to secure the slide bed 56 and an end 118, 120 of a reinforcement 58 to the side rail 52, 54, as described briefly above and in more detail below. It is noted that the number of indentations 94, 96, 98, 100 depicted in the illustrated embodiment is by way of example only and that other numbers of indentations (including none) could be used without departing from the teachings of the present invention.

With respect to the side rails 52, 54, it is finally noted that in the illustrated embodiment, each side rail 52, 54 includes a decorative channel 102, 104 on the exterior side 74, 76 thereof. These channels 102, 104 increase the aesthetic appeal of the slide assembly 14, but it will be readily appreciated by one of ordinary skill in the art that side rails could just as easily be formed without such channels. It is also noted that other aesthetic or dimensional alterations could be made to the side rails 52, 54 of slide assembly 14 of the illustrated embodiment without departing from the teachings of the present invention. For example alternate side rails could be formed having different colors from each other or from the slide bed. Additionally, alternate side rails could be formed with different heights (such as shorter side rails for a lower profile or taller side rails for increased safety). Such an alternative could present a pair of side rails with equal heights or heights that differ from one another, such as for a slide assembly configured to slope in a particular direction. Furthermore, the illustrated side rails 52, 54 are blow-molded polyethylene, although any appropriate forming method, such as injection molding or rotational molding, could similarly be used. Additionally, other suitable materials, such as other plastics or synthetic resins, wood, or metal, could also be used to make alternative side rails, as will be readily appreciated by one of ordinary skill in the art.

With reference now to the exploded views of FIGS. 2-3, the illustrated slide bed 56 comprises a flexible polyethylene sheet that is generally rectangular in shape when viewed from above. The slide bed 56 includes an upper end 106 that corresponds to the upper portion 48 of the slide assembly 14 and also includes a lower end 108 that similarly corresponds to the lower portion 50 of the slide assembly 14. The slide bed 56 presents side margins 110 and 112 that terminate at side edges 111 and 113 oriented on the left and right, respectively, from the vantage point shown in FIG. 1 and consistent with the orientation used herein. Additionally, the slide bed 56 further presents a plurality of holes 114 along the upper end 106, the holes 114 being laterally spaced between the margins 110 and 112. Finally, the slide bed 56 presents a corresponding plurality of holes 116 along the lower end 108, the holes 116 also being laterally spaced between the margins 110 and 112.

In the illustrated embodiment, the slide bed 56 comprises an extruded sheet of polyethylene with a thickness of approximately one eighth of an inch (⅛"), although other suitable synthetic resins or Masonite hardboard could be similarly formed into without departing from the teachings of the present invention. One of ordinary skill in the art will readily appreciate that the thickness of an alternative slide bed can vary so long as it maintains sufficient rigidity to support the weight of an individual using the slide assembly 14 and also remains flexible enough to follow the contours of the path of the grooves 86, 88 of the side rails 52, 54. Preferably, although not necessarily, the length dimension between the farthest reaches of the upper end 106 and the lower end 108 of the slide bed 56 is sufficiently similar to the length dimension of the side rails 52, 54 such that the elements are approximately coterminous when secured together. Additionally, the width dimension between the side edges 111 and 113 of the preferred slide bed 56 is typical of slide assemblies as understood by one of ordinary skill in the art; although such width dimension could extend further outward in an alternative slide bed, provided that adequate reinforcements 58 render support for the weight of an individual using such a slide assembly.

Figure 4:
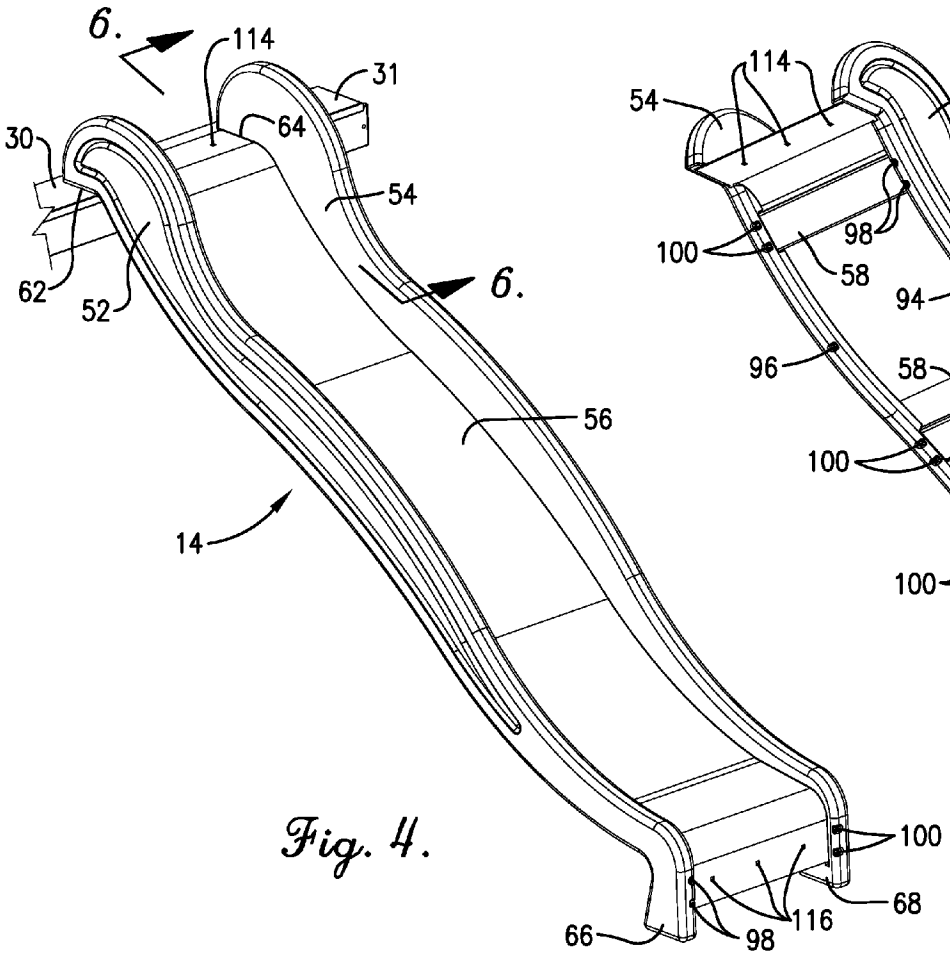
FIG. 4 is a fragmentary perspective view of the slide assembly and associated structure of an upper mounting surface.

As depicted in the assembled views of FIGS. 1, 4, and 5, the margins 110 and 112 of the slide bed 56 are received within the grooves 86, 88 of the side rails 52, 54. In keeping with the orientation of the slide assembly 14 thus described, slide bed side margin 110 is received within groove 86 of side rail 52 and slide bed side margin 112 is received within groove 88 of side rail 54. It is noted that the illustrated slide bed 56 is generally rectangular in shape with edges 111 and 113 being generally parallel. This symmetry allows the illustrated slide bed 56 to be rotated (either side to side, exchanging edges 111 and 113; or top to bottom, exchanging ends 106 and 108) and remain receivable within the grooves 86, 88 of the side rails 52, 54. Such rotation enhances the durable life of the slide bed 56 and increases aesthetic options as different colors can be incorporated on the different surfaces of the slide bed 56. Nevertheless, it will be readily appreciated by one of ordinary skill in the art that the slide bed 56 could just as easily be formed in a different shape so long as the margins thereof are received within corresponding grooves in side rails. It is also noted that other aesthetic alterations could be made to the slide bed 56 without departing from the teachings of the present invention. For example, a slide bed could be the same color as the side rails or be formed in a contrasting color. An alternative slide bed could also present a variety of surface features along a central portion of the bed. It is finally noted that the slide bed need not be flexible in an alternative embodiment (not shown) wherein the path of the grooves cooperatively define a straight path, as discussed above.

With further reference to the exploded views of FIGS. 2-3, the illustrated reinforcements 58 comprise rectangular members with opposed ends 118 and 120. As described above, the recesses 90, 92 of the side rails 52, 54 are configured to receive the ends 118 and 120 of the reinforcements 58 therein. In the illustrated embodiment, reinforcements 58 are wooden members with generally rectangular cross-sections, at least preferably at the ends 118 and 120, although one of ordinary skill in the art will appreciate that such reinforcements could take alternative shapes or be formed from other materials. Accordingly, the recesses 90, 92 of the illustrated embodiment are generally rectangularly shaped to correspond to the shape of the ends 118 and 120 of the reinforcements 58. As shown in FIG. 5, with the ends 118 and 120 of the reinforcement 58 received within the recesses 90, 92 of the side rails 52, 54, each reinforcement 58 extends between the side rails 52, 54 underneath the slide bed 56, adding support and rigidity to the slide assembly 14. It is noted that in the illustrated embodiment, there are four reinforcements 58, each of which are the same size and shape; however, different numbers, sizes, or shapes of reinforcements (including none) could also be incorporated without departing from the teachings of the present invention.

Figure 7:
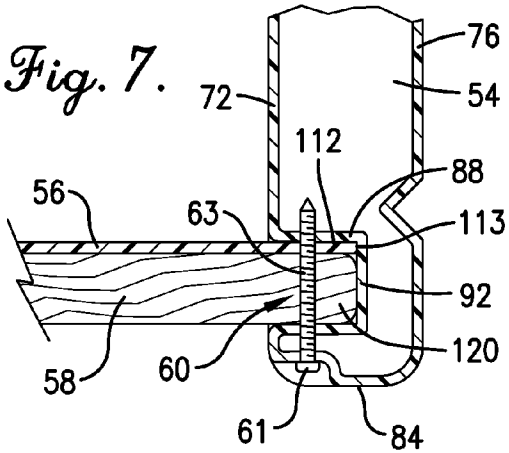
FIG. 7 is an enlarged, fragmentary side sectional view of a portion of the slide assembly, the view taken along the line 7-7 of FIG. 6, particularly illustrating in detail a fastening screw securing an end of a reinforcement in a recess and a margin of the slide bed in the groove of the side rail.
Figure 8:
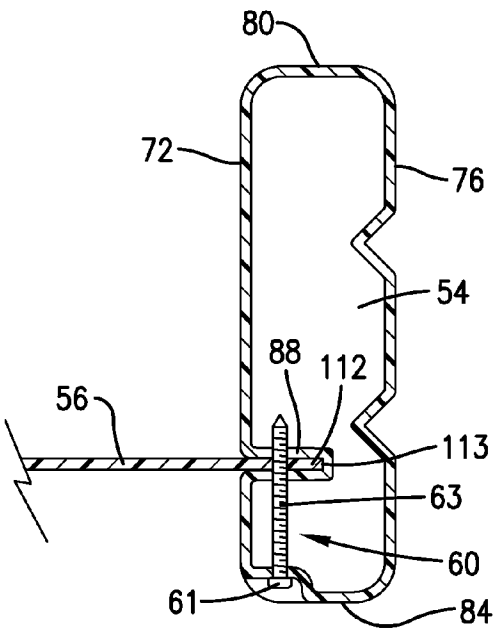
FIG. 8 is an enlarged, fragmentary side sectional view of a portion of the slide assembly, the view taken along the line 8-8 of FIG. 6, particularly illustrating in detail a fastening screw securing a margin of the slide bed in the groove of the side rail.

Turning to FIGS. 7 and 8, attachment of the slide bed 56 and a reinforcement 58 to an exemplary section of side rail 54 is shown in detail using screws 60. Each screw 60 includes a head 61 and a threaded shaft portion 63. In particular, FIG. 7 depicts a portion of side rail 54 with a portion of the margin 112 of the slide bed 56 received within a portion of the groove 88 in side rail 54. FIG. 7 further depicts a portion of the end 120 of a reinforcement 58 received within a portion of the recess 92 in side rail 54. The shaft 63 of the screw 60 is configured such that it extends through the side rail 54, the reinforcement 58, and the margin 112 of the slide bed 56 to selectively secure the components together when interfitted as described above to add stability to the slide assembly 14. The screw 60 extends into the side rail 54 from the bottom surface 84, beginning within an indentation 100, such that the head 61 of the screw 60 does not protrude beyond the bottom surface 84 when the screw 60 is fully tightened to secure the components as described above. It is noted that the portions of the side rail 54, the margin 112 of the slide bed 56, and the end 120 of a reinforcement 58 are depicted in FIG. 7 by way of example only. It is to be understood that such securement is the same at other locations corresponding to indentations 98, 100 along both side rails 52 and 54.

With respect to FIG. 8, a portion of side rail 54 is depicted with a portion of the margin 112 of the slide bed 56 received within the groove 88 in side rail 54. The shaft 63 of the screw 60 is configured such that it extends through side rail 54 and the margin 112 of the slide bed 56 to selectively secure the components together when interfitted as described above to add stability to the slide assembly 14. The screw 60 extends into the side rail 54 from the bottom surface 84, beginning within an indentation 96, such that the head 61 of the screw 60 does not protrude beyond the bottom surface 84 when the screw 60 is fully tightened to secure the components as described above. It is noted that the portions of the side rail 54 and the margin 112 of the slide bed 56 are depicted in FIG. 8 by way of example only. It is to be understood that such securement is the same at other locations corresponding to indentations 94, 96 along both side rails 52 and 54.

It is further noted that the screws 60 of the illustrated embodiment could take other forms without departing from the teachings of the present invention. For example, alternative fasteners (not shown), such as bolts or rivets, could be used in place of screws 60 to secure the components of the slide assembly 14 together. Furthermore, it is within the ambit of the present invention to secure the components of the slide assembly 14 together without fasteners, such as by gluing or applying other permanent bonding after the components are interfitted together.

Figure 6:
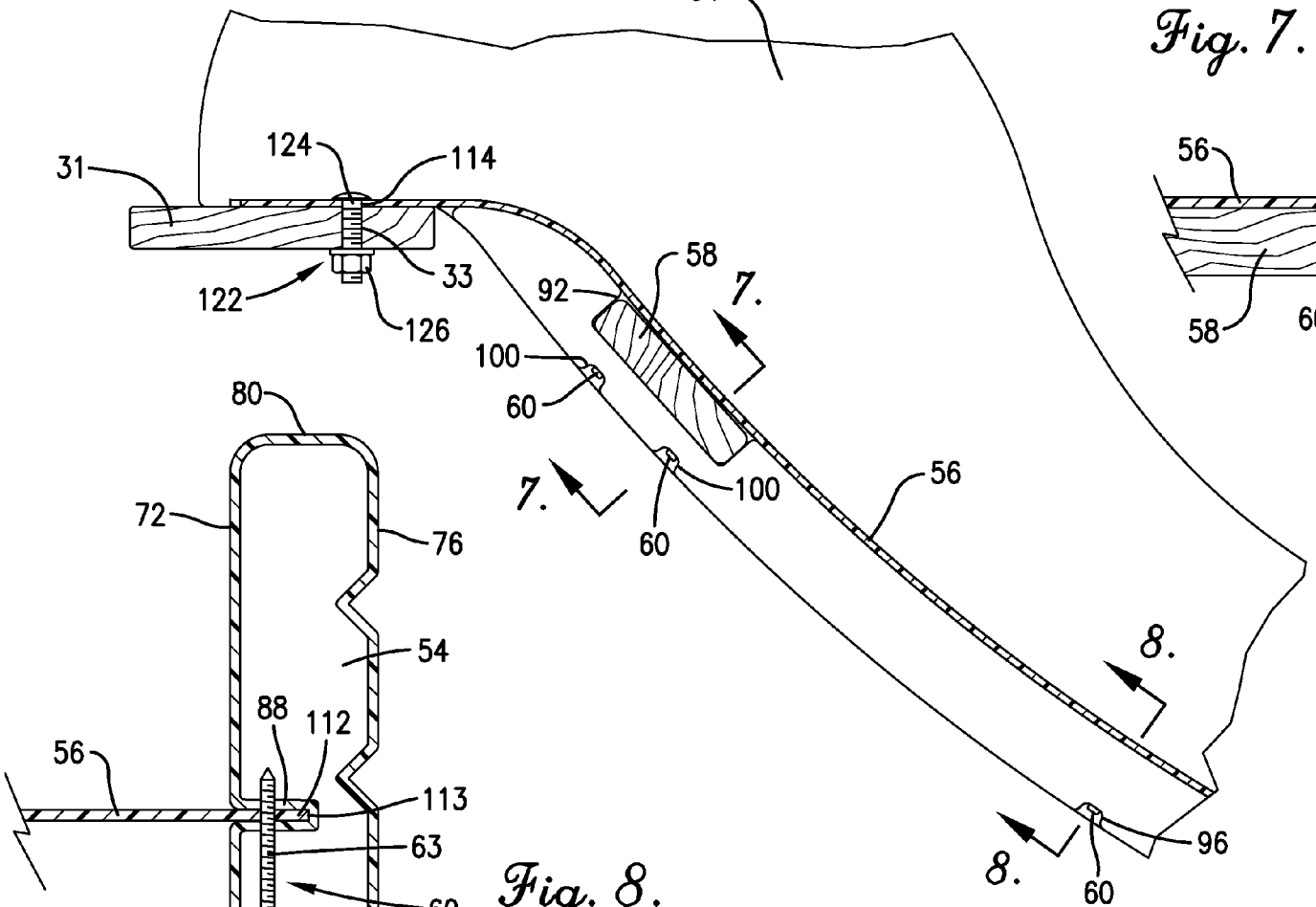
FIG. 6 is an enlarged, fragmentary side sectional view of an upper portion of the slide assembly and associated structure of the upper mounting surface, the view taken along the line 6-6 of FIG. 4, particularly illustrating in detail a connecting bolt securing the slide assembly to the upper mounting surface.

Finally, returning to the illustrated recreational structure 10 of FIG. 1, the slide assembly 14 is secured to the recreation structure 12 at the upper portion 48 of the slide assembly 14. As shown in FIGS. 4 and 6, the slide assembly 14 is secured to the slide mounting area 31 of the platform 30 with a plurality of nut-and-bolt assemblies 122. With the margins 110 and 112 of the slide bed 56 received within the grooves 86, 88 of the side rails 52, 54 as described above, the upper mounting areas 62, 64 of the side rails 52, 54 and corresponding upper end 106 of the slide bed 56 rest on the slide mounting area 31 of the platform 30. As shown particularly in FIG. 6, a bolt 124 extends through a hole 114 at the upper end 106 of the slide bed 56 and through a hole 33 in the platform 30. A nut 126 is tightened on the end of the bolt 124 at each nut-and-bolt assembly 122 to secure the slide assembly 14 to the recreation structure 12.

It is noted the illustrated slide bed 56 presents a plurality of holes 116 along the lower end 108 of the slide bed 56 that mirror the holes 114 at the upper end 106 as described in detail above. Accordingly, after rotation of the illustrated slide bed 56 as described above, the slide assembly can be secured to the recreation structure 12 using holes 116 in like manner as using holes 114. It is also possible to secure the lower end 108 of the slide bed 56 to the lowermost underlying reinforcement 58 using screws or bolts inserted through the holes 116, if desired. It is further noted that alternate manners of securing the slide assembly 14 to the recreation structure 12, such as by gluing or applying other permanent bonding, are also within the ambit of the present invention.

The method of assembling the slide assembly should be apparent from the foregoing description and, therefore, will be described here only briefly. In keeping with the orientation described above, left side margin 110 of the slide bed 56 is secured to the left side rail 52 and right side margin 112 of the slide bed 56 is secured to the right side rail 54 to form the modular slide assembly 14. As shown in the illustrated embodiment, the slide bed 56 is secured to the side rails 52, 54 by inserting the side margins 110 and 112 into the respective grooves 86, 88 of the side rails 52, 54. Reinforcements 58 are preferably, although not necessarily, inserted in recesses 90, 92 of the side rails 52, 54 underlying the slide bed 56.

In the preferred embodiment, the side rails 52, 54 and the slide bed 56 are further secured by inserting screws 60 through a portion of the side rails 52, 54, through the margin 110, 112 of the slide bed 56, and at least partially into a further portion of the side rails 52, 54. As depicted, the screw 60 is inserted at an indentation 94, 96 and tightened sufficiently that the screw head 61 does not protrude outwardly from the side rails 52, 54. Additionally, the side rails 52, 54, the slide bed 56, and the reinforcements 58 are preferably further secured by inserting screws 60 through a portion of the side rails 52, 54, through the end 118, 120 of the reinforcement 58, through the margin 110, 112 of the slide bed 56, and at least partially into a further portion of the side rails 52, 54. As depicted, the screw 60 is inserted at an indentation 98, 100 and tightened sufficiently that the screw head 61 does not protrude outwardly from the side rails 52, 54. While these additional securing steps are preferred, it will be appreciated by one of ordinary skill in the art that a slide assembly could be assembled in accordance with the present invention without such additional securement of the components.

With reference now to FIGS. 9 and 10, a second embodiment of a play set 210 is depicted, wherein a similar recreation structure 212 is combined with an alternative slide assembly 214. The recreation structure 212, shown only in fragmentary view in FIG. 9, includes a slide mounting area 230 and is otherwise very similar to the recreation structure 12. Therefore, for the sake of brevity, additional description of the recreation structure 212 will be avoided.

The slide assembly 214 broadly includes a pair of side rails 252, 254, an intermediate rail 253, multiple slide beds 256, 257, reinforcements 258, 259, and screws 260. The modular components of the alternative slide assembly 214 are similar in many respects to those of slide assembly 14 discussed above, with similar elements being similarly numbered for convenience and maintaining the orientation described above. For the sake of brevity, the description of the second embodiment will focus on the distinctions between elements, with an understanding of the common components being apparent to one of ordinary skill in the art from the description above.

The intermediate rail 253 includes grooves 287, 289 along the length of the rail 253 on both the left side 273 and the right side 275 thereof, which mirror the grooves (not shown) in the side rails 252, 254. A first slide bed 256 is secured to the left side rail 252 and to the intermediate rail 253 to form one side of the modular slide assembly 214. In the illustrated embodiment, the left side margin (not shown) of slide bed 256 is received within groove of the left side rail 252 as described in the embodiment above and the right side margin 312 of slide bed 256 is similarly received within the groove 287 of the intermediate rail 253. Likewise, a second slide bed 257 is secured to the intermediate side rail 253 and to the right side rail 254 to form another side of the modular slide assembly 214. In the illustrated embodiment, the left side margin 313 of slide bed 257 is received within the groove 289 of the intermediate rail 253 and the right side margin (not shown) of slide bed 257 is received within the groove of the right side rail 254 as described in the embodiment above. Reinforcements 258, 259 extend between the left side rail 252 and the intermediate rail 253 and between the intermediate rail 253 and the right side rail 254, respectively, in similar fashion to the embodiment described above. Screws 260 secure the slide beds 256, 257 to the side rails 252, 254 and to the intermediate rail 253. Screws 260 also secure the slide beds 256, 257 and reinforcements 258, 259 to the side rails 252, 254 and to the intermediate rail 253, in similar manner to the embodiment described above.

As depicted in detail in FIG. 10, the left side 273 and the right side 275 of the intermediate rail 253 also present recesses 291, 293 that mirror the recesses (not shown) in the side rails 252, 254. Each recess 291, 293 in the intermediate rail 253 is configured to receive an end 320, 321 of a reinforcement 258, 259 in cooperation with the recesses (not shown) in the side rails 252, 254 in like manner to the embodiment described above. Finally, each screw 260 includes a head 261 and a threaded shaft portion 263. In particular, FIG. 10 depicts a portion of the intermediate rail 253 with a portion of the right side margin 312 of slide bed 256 received within a portion of the groove 287 and a portion of the left side margin 313 of slide bed 257 received within a portion of the groove 289. FIG. 10 further depicts a portion of the right end 320 of reinforcement 258 received within a portion of the recess 291 in intermediate rail 253 and a portion of the left end 321 of reinforcement 259 received within a portion of the recess 293 in intermediate rail 253. The shaft 263 of each screw 260 is configured such that it extends through the intermediate rail 253, the reinforcement 258, 259, and the margin 312, 313 of the slide bed 256, 257 to selectively secure the components together when interfitted as described above to add stability to the slide assembly 214. Each screw 260 extends into the intermediate rail 253 such that the head 261 of the screw 260 does not protrude beyond the outer surface of the intermediate rail 253 when the screw 260 is fully tightened to secure the components as described above. It is to be understood that the portion of the components depicted in FIG. 10 is by way of example only and that such securement is similar to that described above at other locations spaced along the intermediate rail 253 and the side rails 252, 254.

It is briefly noted that the construction of the intermediate rail 253 is readily understood by one of ordinary skill in the art to be similar to that of the side rails 52, 54 described above, differing only in that the width of the intermediate rail 253 is sufficient for the provision of grooves 287, 289 and recesses 291, 293 on both the left side 273 and the right side 275 thereof. It will also be appreciated by one of ordinary skill in the art that an intermediate rail could alternatively be formed as a combination of two side rails as described above without departing from the teachings of the present invention. That is to say, the intermediate rail could alternatively be formed by securing the exterior sides of the left and right side rails to one another. Furthermore, a slide assembly with a greater number of intermediate rails and slide beds than that shown in FIGS. 9 and 10 (for example, a slide assembly with two intermediate rails and three slide beds) is clearly within the ambit of the present invention.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and access the reasonably fair scope of the present invention as pertains to any apparatus not materially departing from but outside the literal scope of the invention set forth in the following claims.

What is claimed is:

1. A slide assembly for use in a play set, said assembly comprising:

a pair of spaced apart elongated side rails, each of said rails including an internal groove extending along the length thereof, said grooves cooperatively defining a curved slide bed path, along which the slide bed is oriented, with the slide bed path including at least one concave portion and at least one convex portion;

a flexible slide bed extending along the length of and being supported by the rails, said slide bed extending laterally between the side rails to present left and right side margins, each of which is received in a respective groove; and a plurality of fasteners securing the slide bed to each of the side rails, each of said fasteners projecting at least partly through one of the side rails in a substantially transverse and upright direction relative to the slide bed to extend through the respective margin of the slide bed received in the corresponding groove.

2. The slide assembly as claimed in claim 1, said grooves each being continuous along the length of each side rail.

3. The slide assembly as claimed in claim 1, said slide bed presenting left and right side edges that are generally parallel to one another.

4. The slide assembly as claimed in claim 3, said side rails being generally symmetric to one another with respect to a slide bed axis, wherein the slide bed axis extends lengthwise down the slide bed and is equidistant from the left and right edges thereof.

5. The slide assembly as claimed in claim 1, said fasteners comprising screws.

6. The slide assembly as claimed in claim 1, said side rails presenting at least one pair of internal recesses, with each of the recesses being below the respective groove; and at least one reinforcement extending between the side rails in an underlying relationship to the slide bed, said at least one reinforcement presenting opposite ends, each of which is received within a respective one of the internal recesses of the side rails.

7. The slide assembly as claimed in claim 6, said slide bed presenting left and right side edges that are generally parallel to one another, said at least one reinforcement extending generally orthogonal to a slide bed axis, wherein the slide bed axis extends lengthwise clown the slide bed and is equidistant from the left and right edges thereof, said at least one pair of internal recesses being aligned with one another along the slide bed axis.

8. The slide assembly as claimed in claim 7, said at least one reinforcement being made of wood.

9. The slide assembly as claimed in claim 1, said slide bed including a plurality of bolt-receiving holes for attachment to a recreation structure, said bolt-receiving holes spaced laterally across an upper portion of the slide bed between the left and right side margins thereof.

10. The slide assembly as claimed in claim 1, each of said side rails comprising a blow-molded plastic body, said slide bed comprising an extruded plastic body.

11. The slide assembly as claimed in claim 1, said side rails being a first color, said slide bed being a second color.

12. The slide assembly as claimed in claim 1; and an intermediate elongated rail spaced between the pair of side rails, said intermediate rail presenting opposite sides, each facing a respective one of the side rails, said intermediate rail including a groove extending along the length of each side thereof, said slide bed presenting a portion supported between the intermediate rail and each side rail, with each slide bed portion presenting an inner margin received in the respective groove of the intermediate rail.

13. A slide assembly for use in a play set, said assembly comprising:

a pair of spaced apart elongated side rails, each of said rails including an internal groove extending along the length thereof;

a slide bed extending along the length of and being supported by the rails, said slide bed presenting left and right side margins, each of which is received in a respective groove, said side rails presenting at least one pair of internal recesses, with each of the recesses being below the respective groove;

at least one reinforcement extending between the side rails in an underlying relationship to the slide bed, said at least one reinforcement presenting opposite ends, each of which is received within a respective one of the internal recesses of the side rails; and a plurality of fasteners securing the slide bed to the at least one reinforcement and to one of the side rails, each of said fasteners projecting at least partly through one of the side rails, the at least one reinforcement, and the respective margin of the slide bed received in the corresponding the groove.

14. The slide assembly as claimed in claim 13, said fasteners comprising screws.

15. A method of assembling a slide for a play set, said slide assembly method comprising the steps:

(a) inserting one side margin of a slide bed into the groove of a first side rail;

(b) inserting the other side margin of the slide bed into the groove of a second side rail;

(c) attaching the slide bed and accompanying side rails to the recreation structure;

(d) securing the slide bed to the side rails; and (e) affixing at least one reinforcement between the side rails in an underlying relationship to the slide bed, step (e) including the step of positioning opposite ends of the reinforcement in recesses defined in the side rails, steps (d) and (e) including the step of securing the slide bed to the at least one reinforcement and the side rails with a plurality of fasteners.

16. The slide assembly method as claimed in claim 15, step (d) including the step of projecting each of the fasteners at least partly through one of the side rails and the respective margin of the slide bed received in the corresponding the groove.

17. The slide assembly method as claimed in claim 16, steps (a) and (b) including the step of flexing the slide bed along a curved slide bed path defined by the groves of the side rails.

18. The slide assembly method as claimed in claim 15, step (d) including the step of projecting each of the fasteners at least partly through one of the side rails, the at least one reinforcement, and the respective margin of the slide bed received in the corresponding the groove.

19. A slide assembly for use in a play set, said assembly comprising:

a pair of spaced apart elongated side rails, each of said rails including an internal groove extending along the length thereof;

a flexible slide bed extending along the length of and being supported by the rails, said slide bed presenting left and right side margins, each of which is received in a respective groove;

at least one reinforcement extending between the side rails, with opposite ends of the reinforcement being coupled to the side rails; and a plurality of fasteners securing the slide bed to the at least one reinforcement and to the side rails, each of said fasteners projecting at least partly through one of the side rails, the at least one reinforcement, and the respective margin of the slide bed received in the corresponding the groove.

20. The slide assembly as claimed in claim 19, said grooves cooperatively defining a curved slide bed path, along which the slide bed is oriented.

21. The slide assembly as claimed in claim 20, said slide bed flexibly bending along the curved slide bed path.

22. The slide assembly as claimed in claim 21, said slide bed comprising a unitary molded body.

23. The slide assembly as claimed in claim 19, said side rails presenting at least one pair of internal recesses, with each of the recesses being below the respective groove, said at least one reinforcement extending between the side rails in an underlying relationship to the slide bed, each of said opposite ends of the at least one reinforcement being received within a respective one of the internal recesses of the side rails.

24. The slide assembly as claimed in claim 23, said slide bed presenting left and right side edges that are generally parallel to one another, said at least one reinforcement extending generally orthogonal to a slide bed axis, wherein the slide bed axis extends lengthwise down the slide bed and is equidistant from the left and right edges thereof, said at least one pair of internal recesses being aligned with one another along the slide bed axis.

25. The slide assembly as claimed in claim 24, said at least one reinforcement being made of wood.

26. The slide assembly as claimed in claim 19; and an intermediate elongated rail spaced between the pair of side rails, said intermediate rail presenting opposite sides, each facing a respective one of the side rails, said intermediate rail including a groove extending along the length of each side thereof, said slide bed presenting a portion supported between the intermediate rail and each side rail, with each slide bed portion presenting an inner margin received in the respective groove of the intermediate rail.

* * * * *